US011376611B2

(12) United States Patent
Fan et al.

(10) Patent No.: US 11,376,611 B2
(45) Date of Patent: Jul. 5, 2022

(54) WATER OUTLET DEVICE

(71) Applicant: Xiamen Solex High-Tech Industries Co., Ltd., Xiamen (CN)

(72) Inventors: Qihua Fan, Xiamen (CN); Wenxing Chen, Xiamen (CN); Fengde Lin, Xiamen (CN)

(73) Assignee: Xiamen Solex High-Tech Industries Co., Ltd., Xiamen (CN)

( * ) Notice: Subject to any disclaimer, the term of this patent is extended or adjusted under 35 U.S.C. 154(b) by 143 days.

(21) Appl. No.: 16/706,959

(22) Filed: Dec. 9, 2019

(65) Prior Publication Data

US 2020/0179958 A1 Jun. 11, 2020

(30) Foreign Application Priority Data

Dec. 7, 2018 (CN) ..... 201811494692.4

(51) Int. Cl.

| | |
|---|---|
| ***B05B 1/18*** | (2006.01) |
| ***B05B 1/08*** | (2006.01) |
| ***B05B 3/02*** | (2006.01) |

(52) U.S. Cl.

CPC ..... *B05B 1/185* (2013.01); *B05B 1/083* (2013.01); *B05B 3/02* (2013.01)

(58) Field of Classification Search

CPC ..... B05B 1/185; B05B 1/083; B05B 3/02; B05B 15/652; B05B 1/18

See application file for complete search history.

(56) References Cited

U.S. PATENT DOCUMENTS 5,833,138 A * 11/1998 Crane ..... B05B 15/5225 239/106

* cited by examiner

*Primary Examiner* — Qingzhang Zhou

(74) *Attorney, Agent, or Firm* — Cooper Legal Group, LLC

(57) ABSTRACT

The present disclosure discloses a water outlet device comprising a water outlet portion and a moving portion disposed in the water outlet portion. The water outlet portion comprises a body portion and a cover portion. The cover portion comprises a first water outlet nozzle, and the moving portion is movable relative to the cover portion. A transmission mechanism is disposed between the moving portion and the water outlet portion, and the transmission mechanism drives the moving portion to move toward the cover portion and away from the cover portion. The moving portion comprises an insertion portion. Movement of the moving portion controls the insertion portion to insert or pull out from the first water outlet nozzle, and the first water outlet nozzle discharges different water spray patterns when the insertion portion is inserted into or pulled away from the first water outlet nozzle.

12 Claims, 12 Drawing Sheets

WATER OUTLET DEVICE

RELATED APPLICATIONS

This application claims priority to Chinese Patent Application 201811494692.4, filed on Dec. 7, 2018. Chinese Patent Application 201811494692.4 is incorporated herein by reference.

FIELD OF THE DISCLOSURE

The present disclosure relates to the field of bathroom fixtures, in particular to a water outlet device.

BACKGROUND OF THE DISCLOSURE

Existing water outlet devices, such as described in CN207119498U, comprise a body, a descaling needle plate disposed in the body, and a rotating member driven by water flow and rotating about an axial direction. The descaling needle plate and a water outlet cover are coaxially disposed, and the descaling needle plate has a plurality of needles. The descaling needle plate is oscillatingly connected with the rotating member. When water flows in the water outlet device, the water flow drives the rotating member to rotate, and the rotating member drives the needles to swing around the axial direction at a water outlet hole of the cover plate. The needles rub against scale attached to an inner side wall of the water outlet hole during the swinging process, so that the scale attached to the inner side wall of the water outlet hole falls off as the needles swings. The descaling needle plate can move toward and away from the cover plate. The needles of the descaling needle plate are inserted into the water outlet holes when the water is being discharged, and the needles pulls out of the water outlet holes when the water is turned off. The water exiting out of the water outlet holes has only a single water pattern (i.e., water outlet effect), and does not have different water patterns, so there is demand for improved water outlet devices.

BRIEF SUMMARY OF THE DISCLOSURE

The present disclosure provides a water outlet device to solve deficiencies of the existing techniques.

In order to solve the aforementioned technical problems, a first technical solution of the present disclosure is as follows.

A water outlet device, comprising: a water outlet portion and a moving portion disposed in the water outlet portion. The water outlet portion comprises a body portion and a cover portion connected to the body portion. The cover portion comprises at least one first water outlet nozzle, and the moving portion is movable relative to the cover portion. Movement between the cover portion and the moving portion at least comprises movement of the moving portion toward the cover portion and away from the cover portion, and a transmission mechanism is disposed between the moving portion and the water outlet portion. The transmission mechanism drives the moving portion to move toward the cover portion and away from the cover portion. The moving portion comprises at least one insertion portion, and movement of the moving portion controls the at least one insertion portion to insert into or pull out from the at least one first water outlet nozzle. The at least one first water outlet nozzle discharges different water spray patterns when the insertion portion is inserted into or pulled out from the at least one first water outlet nozzle.

In another preferred embodiment, the water outlet device further comprises a driving mechanism. The movement of the moving portion further comprises a circulating movement, and the circulating movement comprises a circular movement or an oscillating movement of the at least one insertion portion around an axis of the at least one first water outlet nozzle.

In another preferred embodiment, the driving mechanism comprises an impeller, the impeller is rotatable in the water outlet portion, and the impeller and the moving portion are drivably connected.

In another preferred embodiment, the cover portion is rotatably connected to the body portion, and the transmission mechanism cooperates with the moving portion and the body portion. When the cover portion rotates relative to the body portion, the transmission mechanism drives the moving portion to move toward to the cover portion and away from the cover portion.

In another preferred embodiment, the transmission mechanism comprises a guiding surface disposed on the water outlet portion and at least one positioning rod connected to the moving portion and moving in synchronization with the moving portion. An upper end of the at least one positioning rod is abuttable against the guiding surface. Movement of the at least one position rod is controllable through a relative rotation of the guiding surface and the at least one positioning rod. The movement of the moving portion is controllable.

In another preferred embodiment, the body portion is disposed with the guiding surface.

In another preferred embodiment, each of the at least one positioning rod comprises a shoulder, and the moving portion comprises a movable plate. The at least one insertion portion is fixedly connected to the movable plate, and the movable plate is provided with at least one through hole. The upper end of each of the at least one positioning rod passes through a corresponding one of the at least one through hole, and the shoulder abuts against a bottom surface of the movable plate.

In another preferred embodiment, the cover portion comprises a water outlet cover, and the at least one first water outlet nozzle is disposed on the water outlet cover. The movement of the moving portion toward the cover portion and away from the cover portion moves the moving portion toward and away from the water outlet cover. A first elastic body configured to reset the moving portion is disposed between a lower end of the at least one positioning rod and the water outlet cover or disposed between the moving portion and the water outlet cover.

In another preferred embodiment, a second elastic body is disposed between the at least one positioning rod and the body portion, or the second elastic body is disposed between the moving portion and the body portion.

In another preferred embodiment, an elastic reset mechanism is disposed between the moving portion and the water outlet portion.

In another preferred embodiment, the water outlet portion comprises a water inlet passage and at least two water dividing passages, and each of the at least two water dividing passages is switched to be connected to the water inlet passage by rotating the cover portion relative to the body portion. The cover portion further comprises other water outlet nozzles. A first one of the at least two water dividing passages is connected to the at least one first water outlet nozzle, and others of the at least two water dividing passages are connected to the other water outlet nozzles.

In another preferred embodiment, the at least two water dividing passages at least comprise a first water dividing passage and a second water dividing passage. Each of the other water outlet nozzles at least comprises at least one second water outlet nozzle. The cover portion is rotatable between at least a first position, a second position and a third position relative to the body portion. When the cover portion is rotated to the first position or the second position, the first water dividing passage is connected to the water inlet passage, and the cover portion is rotated between the first position and the second position to control the movement of the moving portion. When the cover portion is rotated to the third position, the second water dividing passage is connected to the at least one second water outlet nozzle.

In another preferred embodiment, the water outlet portion comprises a switching mechanism, and the water inlet passage comprises a water inlet port located in the body portion. Each of the at least two water dividing passages comprises a water dividing port configured to follow a rotation of the cover portion, and the switching mechanism comprises the water inlet port and the water dividing port. The water dividing port is configured to be connected to the water inlet port by rotating the cover portion.

A second technical solution of the present disclosure is as follows.

A water outlet device, comprising: a water outlet portion and a moving portion disposed in the water outlet portion. The water outlet portion comprises a body portion and a cover portion rotatably connected to the body portion. The water outlet portion comprises a water inlet passage and at least two water dividing passages. The cover portion comprises at least one first water outlet nozzle configured to be connected to one of the at least two water dividing passages, and the moving portion is configured to move relative to the cover portion. Movement of the moving portion comprises movement of the moving portion toward the cover portion and away from the cover portion, and the moving portion comprises at least one insertion portion. The at least one insertion portion is configured to be inserted into or pulled out from the at least one first water outlet nozzle by moving the moving portion toward the cover portion and away from the cover portion. The at least one first water outlet nozzle discharges different water spray patterns when the insertion portion is inserted into or pulled out from the at least one first water outlet nozzle. Rotation of the cover portion relative to the body portion is configured to drive one of the at least two water dividing passages to connect to the water inlet passage, and the rotation of the cover portion relative to the body portion is configured to drive the moving portion to move toward the cover portion and away from the cover portion.

In another preferred embodiment, the at least two water dividing passages comprise a first water dividing passage and a second water dividing passage. The cover portion is configured to rotate between at least a first position, a second position, and a third position relative to the body portion. When the cover portion is rotated to the first position or the second position, the first water dividing passage is connected to the water inlet passage, and the rotation of the cover portion between the first and second positions controls the moving portion to move toward the cover portion and away from the cover portion. When the cover portion is rotated to the third position, the second water dividing passage is connected to the water inlet passage.

A third technical solution of the present disclosure is as follows.

A water outlet device, comprising: a water outlet portion, a moving portion disposed in the water outlet portion and an operating member. The water outlet portion comprises a body portion, a cover portion and a switching mechanism connected together. The water outlet portion comprises a water inlet passage and at least two water dividing passages. The operating member is drivingly connected to the switching mechanism, and at least two water dividing passages are switched to be connected to the water inlet passage through movement of the switching mechanism relative to the body portion. The cover portion comprises at least one first water outlet nozzle that is configured to be connected to one of the at least two water dividing passages. The moving portion is configured to move relative to the cover portion, and movement of the moving portion comprises movement of the moving portion toward the cover portion and away from the cover portion. The operating member is drivably connected to the moving portion to drive the movement of the moving portion toward the cover portion and away from the cover portion. The moving portion comprises at least one insertion portion, and the at least one insertion portion is inserted into or pulled out from the at least one first water outlet nozzle through the movement of the moving portion toward the cover portion and away from the cover portion. The at least one first water outlet nozzle discharges different water spray patterns when the at least one insertion portion is inserted into or pulled out from the at least one first water outlet nozzle.

In another preferred embodiment, the at least two water dividing passages comprise a first water dividing passage and a second water dividing passage. The operating member is rotatable between at least a first position, a second position, and a third position relative to the body portion. When the operating member is rotated to the first position or the second position, the first water dividing passage is connected to the water inlet passage, and movement of the operating member between the first position and the second position drives the moving portion to move toward the cover portion and away from the cover portion. When the operating member is rotated to the third position, the second water dividing passage is connected to the water inlet passage.

Compared with the background art, the technical solution has the following advantages.

The insertion portion is inserted into or pulled out from the first water outlet nozzle by controlling movement of the moving portion toward the cover portion and away from the cover portion. The first water outlet nozzle discharges different water spray patterns when the insertion portion is inserted into or pulled out from the first water outlet nozzle, and the shower area can be increased.

Movement of the moving portion further comprises a circulating movement, in which the insertion portion perform a circular movement or an oscillating movement around the axis of the first water outlet nozzle. The insertion portion pulls out from the first water outlet nozzle. The insertion portion and the first water outlet nozzle are spaced apart, and the circulating movement of the insertion portion does not affect the spray pattern of the first water outlet nozzle. The insertion portion is inserted into the first water outlet nozzle, and the first water outlet nozzle can discharge another water spray pattern by the circulating movement of the insertion portion.

The cover portion is rotatably attached to the body portion, and the transmission mechanism cooperates with the moving portion and the body portion. When the cover portion is rotated relative to the body portion by the transmission mechanism, the moving portion can be moved toward the cover portion and away from the cover portion. The operation is convenient, and the structure is simple.

The relative rotation of the guiding surface and the positioning rod controls the movement of the positioning rod toward the cover portion and away from the cover portion and the movement of the moving portion toward the cover portion and away from the cover portion. The structure is simple and compact, and the operation is stable and reliable.

The water outlet portion is provided with a water inlet passage and at least two water dividing passages, and the at least two water dividing passages are switched to be connected to the water inlet passage by rotating the cover portion relative to the body portion. The cover portion further comprises other water outlet nozzles in addition to the first water outlet nozzle, and one water dividing passage is correspondingly connected to the first water outlet nozzle. The other water dividing passages and the other water outlet nozzles are respectively connected, and the movement of the moving portion toward the cover portion and away from the cover portion and the water passage switching are combined. The switching of all the water passages and the movement of the moving portion toward the cover portion and away from the cover portion can be realized by the rotation of the cover portion. The structure is simple and compact and easy to operate.

The at least two water dividing passages are controlled to be connected to the water inlet passage by rotating the cover portion relative to the body portion, and the movement of the moving portion toward the cover portion and away from the cover portion is controlled by the rotation of the cover portion relative to the body portion. The switching of all the water passages and the movement of the moving portion toward the cover portion and away from the cover portion can be realized by the rotation of the cover portion. The structure is simple and compact and easy to operate.

The operating member is drivably connected to the switching mechanism. The at least two water dividing passages are controlled to switch to connect to the water inlet passage through the movement of the switching mechanism relative to the body portion, and the operating member drives the moving portion to control the movement of the moving portion toward the cover portion and away from the cover portion. The switching of all the water passages and the movement of the moving portion toward the cover portion and away from the cover portion can be realized by the operation of the operating member. The structure is simple and compact and easy to operate.

BRIEF DESCRIPTION OF THE DRAWING

The present disclosure will be further described below with the combination of the accompanying drawings together with the embodiments.

DETAILED DESCRIPTION OF THE EMBODIMENTS

Embodiment 1

Figure 1:
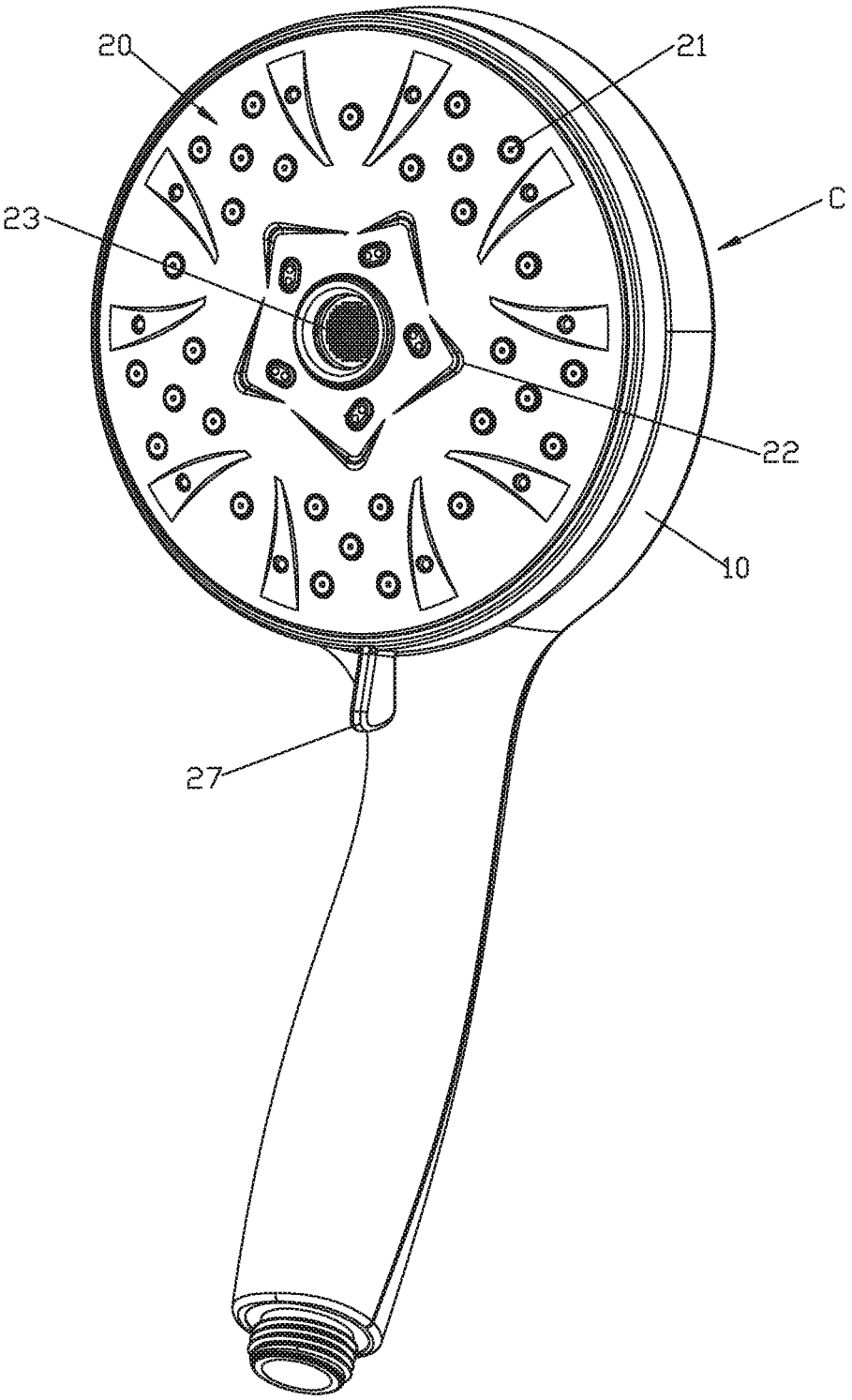
FIG. 1 illustrates a perspective schematic view of a water outlet device of a specific embodiment.
Figure 2:
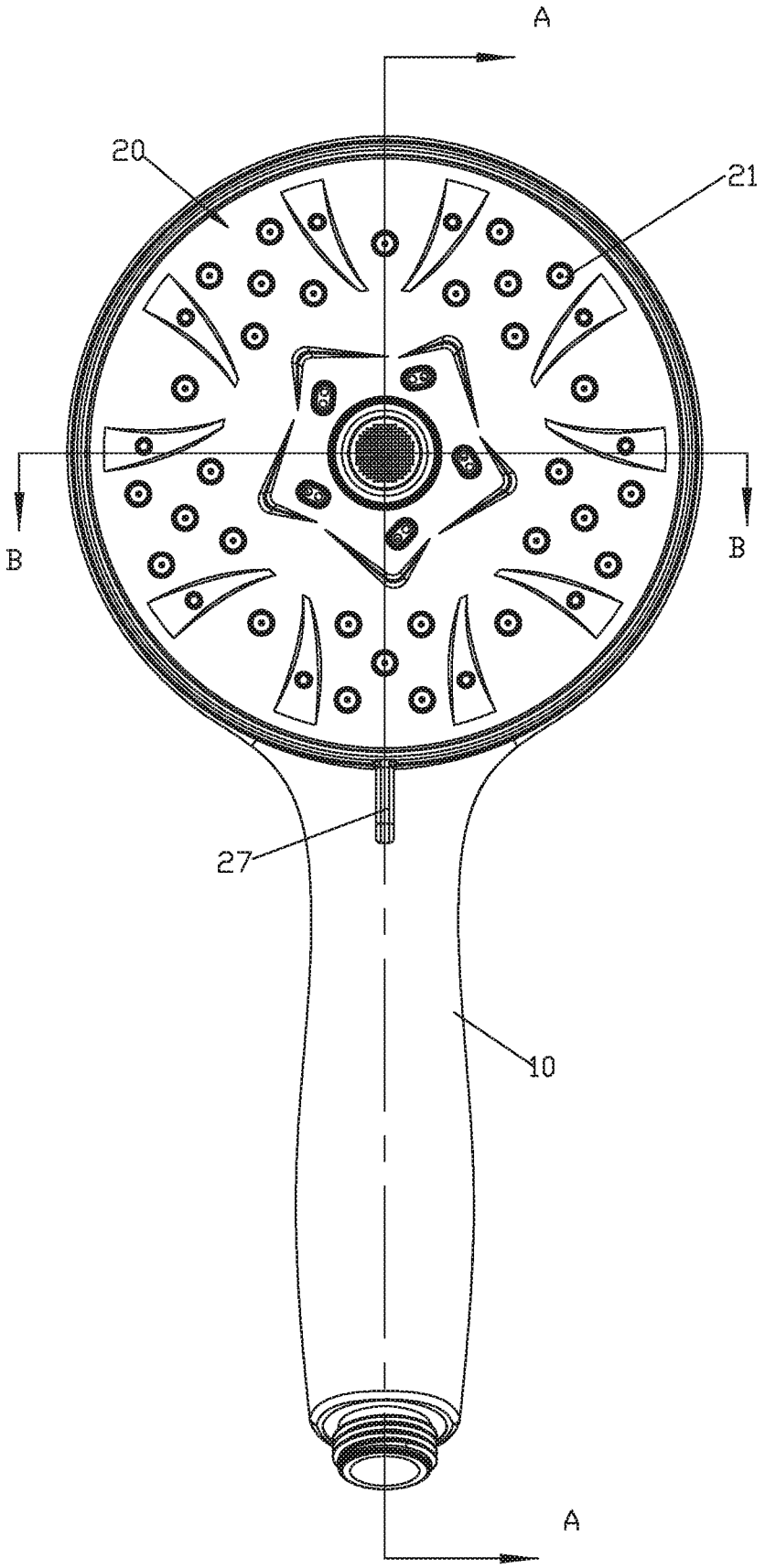
FIG. 2 illustrates a bottom view of the water outlet device of the specific embodiment.
Figure 3:
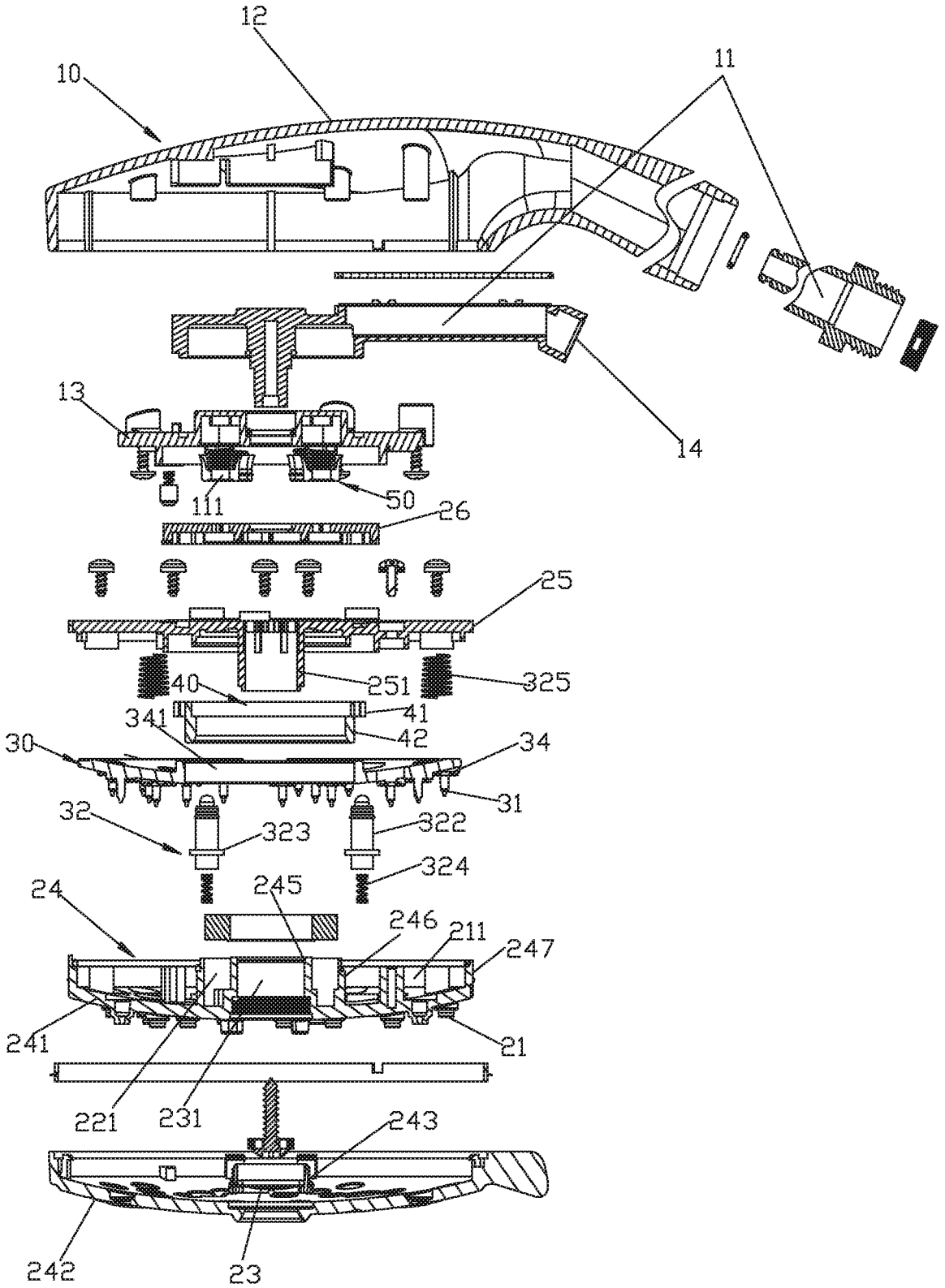
FIG. 3 illustrates an exploded perspective view of the water outlet device of the specific embodiment.

Referring to FIGS. 1-9, by way of example, a water outlet device in this embodiment is a shower, and the shower comprises a water outlet portion C and a moving portion 30 disposed in a cover portion 20 of the water outlet portion C. The water outlet portion C comprises a body portion 10 and the cover portion 20. The cover portion 20 is configured to be rotatably disposed under the body portion 10. The cover portion 20 comprises a water outlet cover 24. The water outlet cover 24 comprises at least one first water outlet nozzle 21, at least one second water outlet nozzle 22 and at least one third water outlet nozzle 23. The moving portion 30 is configured to move relative to the cover portion 20, and movement of the moving portion 30 comprises movement of the moving portion toward the cover portion 20 and away from the cover portion 20 and a circular movement or an oscillating movement of a insertion portion 31 around an axis of the first water outlet nozzle 21 (by way of example, the first water outlet nozzle 21 is a rotation structure, and the axis of the first water outlet nozzle 21 is an rotation axis). A transmission mechanism 32 is disposed between the moving portion 30 and the water outlet portion C. The moving portion 30 is driven by the transmission mechanism 32 to move toward the cover portion 20 and away from the cover portion 20. The moving portion 30 is provided with an insertion portion 31, which is driven to insert into or pull out from the first water outlet nozzle 21 through the movement of the moving portion 30 toward the cover portion 20 and away from the cover portion 20. The water outlet device comprises a driving mechanism 40. The driving mechanism 40 is configured to drive the moving portion 30 to move in cycles, according to different requirements. The driving mechanism 40 is configured to drive the moving portion 30 to movement in a circulating fashion, or a clutch mechanism is provided, so that the driving mechanism 40 drives the insertion portion 31 to move in the circulating fashion when the insertion portion 31 is inserted into the at least one first water outlet nozzle 21, and stop circulating when the insertion portion 31 is pulled out from the at least one first water outlet nozzle 21. The at least one first water outlet nozzle 21 discharges different water spray patterns when the insertion portion 31 is inserted into or pulled out from the at least one first water outlet nozzle 21.

In the specific embodiment, the transmission mechanism 32 cooperates with the moving portion 30 and the body portion 10. When the cover portion 20 is rotated relative to the body portion 10, the transmission mechanism 32 drives the moving portion 30 to move toward the cover portion 20 and away from the cover portion 20. When the insertion portion 31 of the moving portion 30 is inserted into the at least one first water outlet nozzle 21, the moving portion 30 is in a first state. When the insertion portion 31 of the moving portion 30 is pulled out from the at least one first water outlet nozzle 21, the moving portion 30 a second state. In a specific structure, the transmission mechanism 32 comprises a guiding surface 321 disposed on the water outlet portion C and arranged downward, and at least one positioning rod 322 connected to the moving portion 30 and moving in synchronism with the moving portion 30. The guiding surface 321 comprises a spiral surface. The at least one positioning rod 322 is movably connected to the cover portion 20 to move toward the cover portion 20 and away from the cover portion 20, so that the at least one positioning rod 322 and the cover portion 20 form a synchronous rotation relationship. An upper end of the at least one positioning rod 322 is abuttable to the guiding surface 321. The rotation of the cover portion 20 and the body portion 10 is configured to drive the positioning rod 322 to rotate relative to the guiding surface 321. The relative rotation of the guiding surface and positioning rod controls the movement of the positioning rod toward the cover portion 20 and away from the cover portion 20, and controls the movement of the moving portion toward the cover portion 20 and away from the cover portion 20. Moreover, a space 33 is provided between the positioning rod and the moving portion 30 for the circulating movement of the moving portion 30. The positioning rod 322 comprises a shoulder 323. The moving portion 30 comprises a movable plate 34. The insertion portion 31 is a needle fixed on the bottom surface of the movable plate 34. The movable plate 34 is provided with a through hole 35, and the upper end of the positioning rod 322 penetrates through the through hole 35. The shoulder 323 abuts the bottom surface of the movable plate 34. The above-mentioned space 33 is provided between the inner wall of the through hole 35 and the outer wall of the positioning rod 322. The inner diameter of the through hole is greater than the outer diameter of the positioning rod 322, and the portion between the inner and outer diameters constitutes the above-mentioned space 33. As needed, a reaming hole 351 may be provided at the lower part of the through hole 35, and the shoulder 323 is located in the reaming hole. The shoulder 323 abuts the bottom surface of the reaming hole 351, which substantially constitutes a portion of the bottom surface of the movable plate, thereby providing a compact structure, so that the insertion portion 31 can be inserted into the first water outlet nozzle 21. A first elastic body 324 for resetting the moving portion 30 is disposed between the lower end of the positioning rod 322 and the water outlet cover 24 of the cover portion 20, and a second elastic body 325 is disposed between the moving portion 30 and the body portion 10.

The driving mechanism 40 comprises an impeller 41 rotatably disposed in the cover portion 20. The impeller 41 comprises a cam 42. The moving portion 30 is disposed with a fitting hole 341 at the center of the movable plate 34. The cam 42 is coupled to the fitting hole 341. Water impacts the impeller 41 to drive the impeller 41 to rotate. The impeller 41 drives the cam 42 to rotate. The cam 42 drives the movable plate 34 to move eccentrically, that is, drives the axis of the movable plate 34 to perform a circular movement or an oscillating movement around the axis of the impeller 41 to drive the at least one insertion portion 31 to move cyclically. In this specific embodiment, regardless of a distance of the moving portion 30, the cam 42 and the movable plate 34 are always in a coupled state.

The body portion 10 is disposed with a water inlet passage 11, and the cover portion 20 is disposed with three water dividing passages 211, 221, and 231. The three water dividing passages 211, 221, and 231 are divided into a first water dividing passage 211, a second water dividing passage 221, and a third water dividing passage 231. The cover portion 20 is configured to be rotated relative to the body portion 10 to drive the first water dividing passage 211, the second water dividing passage 221, and the third water dividing passage 231 to switch to connect to the water inlet passage 11. The first water dividing passage 211 is connected to the at least one first water outlet nozzle 21, the second water dividing passage 221 is connected to the at least one second water outlet nozzle 22, and the third water dividing passage 231 is connected to the at least one third water outlet nozzle 23. In the specific structure, the water outlet portion C comprises a switching mechanism 50. The water inlet passage 11 comprises a water inlet 111 disposed in the body portion 10. Each of the first water dividing passage 211, the second water dividing passage 221, and the third water dividing passage 231 comprises a water outlet configured to follow a rotation of the cover portion 20. The switching mechanism 50 comprises the water inlet 111 and the above water outlets, and the cover portion 20 is rotated to drive the water outlet to switch to connect to the water inlet 111, so as to control the switching of the first water dividing passage 211, the second water dividing passage 221, and the third water dividing passage 231 to control water spray pattern of the water outlet device. The above-mentioned impeller 41 is in the first water dividing passage 211. As long as there is a water flow in the first water dividing passage 211, the impeller 41 rotates, and the rotation of the impeller 41 causes the moving portion to circulate.

The cover portion 20 is rotatable between at least a first position, a second position, a third position and a fourth position relative to the body portion 10. When located in the first and second positions, the first water dividing passage 211 is connected to the water inlet passage 11 and the cover portion 20 is rotated between the first position and the second position to control the movement of the moving portion 30 toward the cover portion 20 and away from the cover portion 20. So that the first water dividing passage 211 is connected to the water inlet passage 11 when the at least one insertion portion 31 of the moving portion 30 is inserted into or pulled out from the at least one first water outlet nozzle. When located in the third position, the second water dividing passage 221 is correspondingly connected to the water inlet passage 11, and when located in the fourth position, the third water dividing passage 231 is correspondingly connected to the water inlet passage 11. For another example, the cover portion 20 can also be rotated to a fifth position relative to the body portion 10, and when located in the fifth position, the first water dividing passage 211 and the second water dividing passage 221 are connected to the water inlet passage 11. In this specific embodiment, N water dividing passages can be set according to needs of the water outlet device, and the cover portion 20 can move in N+1 positions relative to the body portion 10. The first water dividing passage 211 is connected to the water inlet passage 11 when located in two positions.

In this embodiment, in addition to the spiral surface, the guiding surface 321 comprises a plane connected to a lower end of the spiral surface. The lower end of the guiding surface 321 corresponds to the first position, a higher end corresponds to the second position, and the remaining positions are located on the plane.

In the specific embodiment, the movement of the moving portion 30 toward the cover portion 20 and away from the cover portion 20 is controlled by the cooperation of the guiding surface 321 and the positioning rod 322, but it is not limited thereto. Other structures, such as a rack and pinion structure, may be used as needed. Some of the rotation is idling, some of the rotation makes the rack and the pinion structure to be meshed, when the rack and the pinion structure are meshed, the moving portion 30 is driven to move toward the cover portion 20 and away from the cover portion 20, and when in idling state, the waterway is switched.

Figure 11:
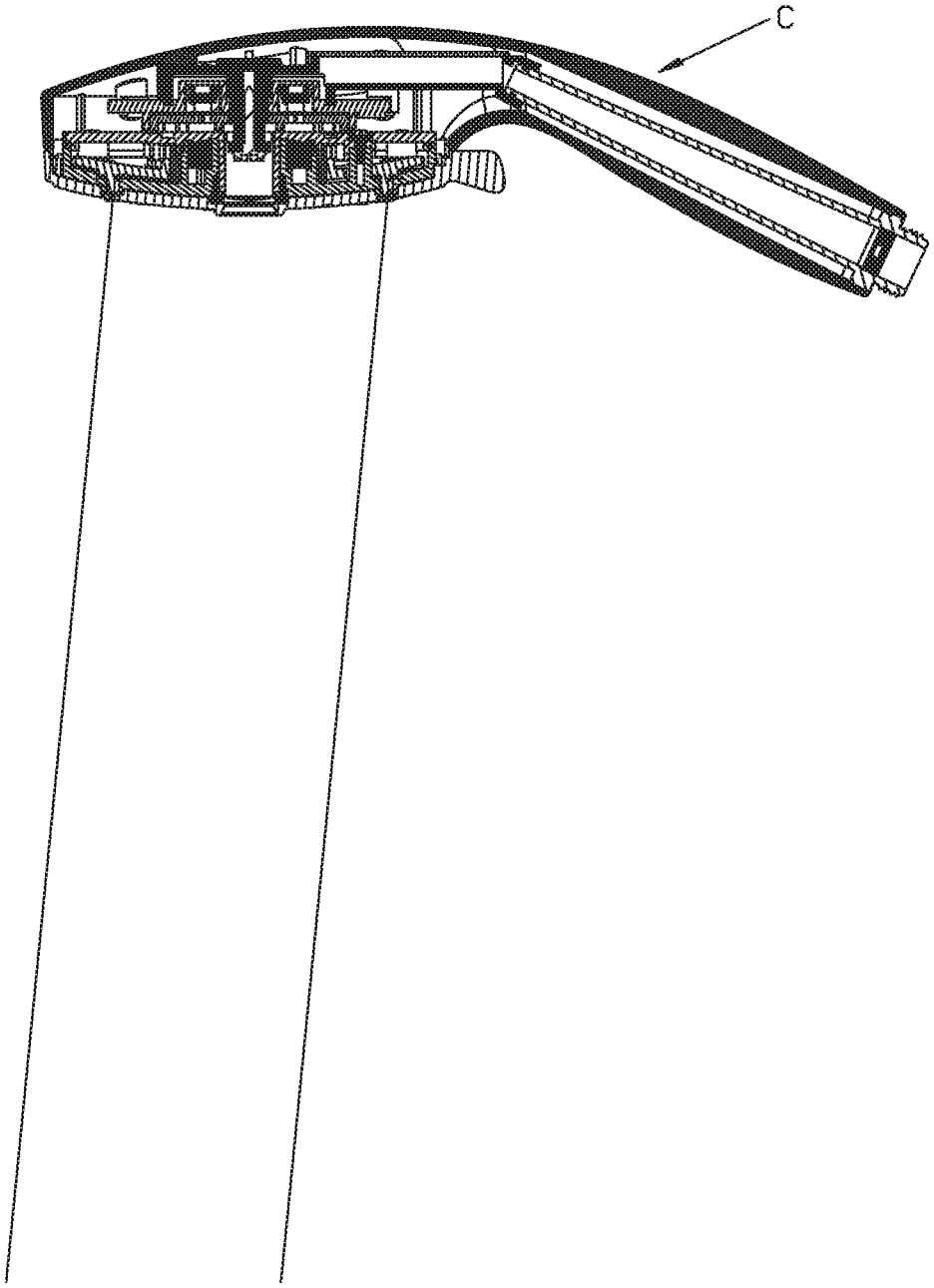
FIG. 11 illustrates a schematic view of a first spray pattern of the water outlet device of the specific embodiment.
Figure 12:
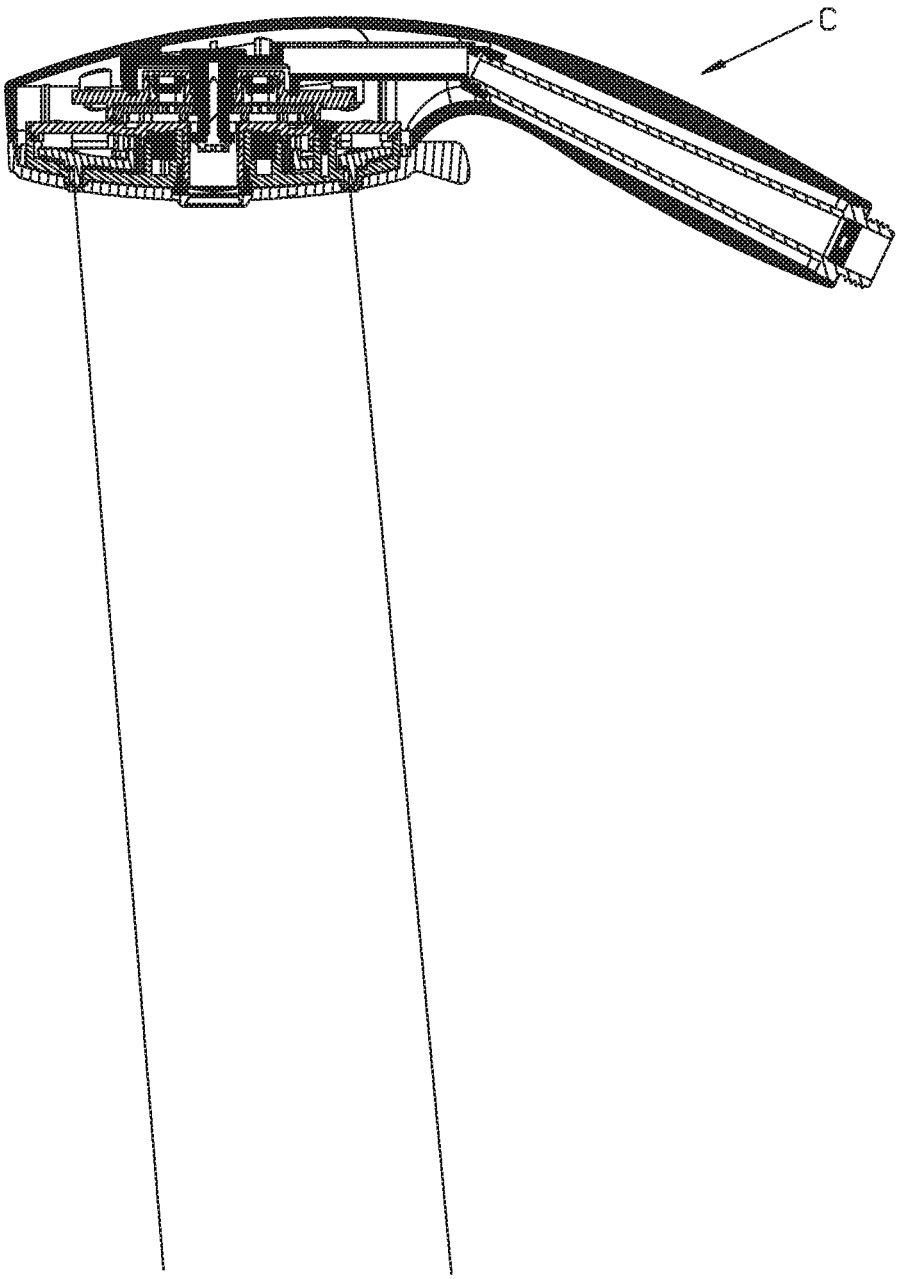
FIG. 12 illustrates a schematic view of a second spray pattern of the water outlet device of the specific embodiment.
Figure 13:
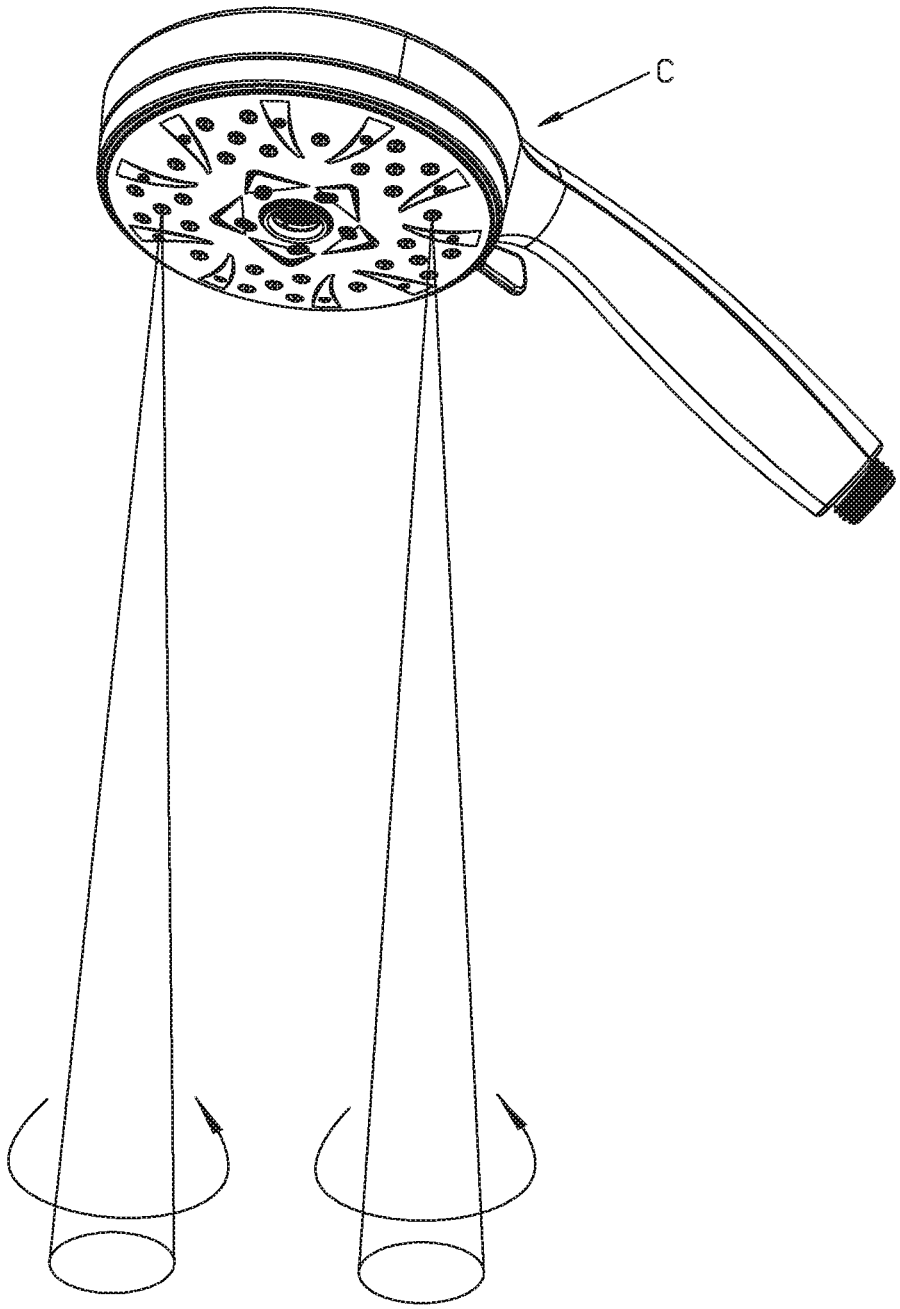
FIG. 13 illustrates a schematic view of a third pray pattern of the water outlet device of the specific embodiment.

The at least one first water outlet nozzle 21 of the water outlet device of the specific embodiment can discharge two kinds of water spray patterns (when being inserted into the at least one water outlet nozzle, the water spray pattern is vibration shower water, when being pulled out from the at least one water outlet nozzle, the water spray pattern is shower water). The at least one second water outlet nozzle 22 can discharge massage water, and the at least one third water outlet nozzle 23 can discharge sheet water. By means of cooperation, the water outlet device can be a five-function shower. The five functions are: shaking water, shower water, massage water, sheet water and "mixed water of shower water and massage water". The shaking water is as shown in FIG. 11. When the movable plate 34 is on the left side, the water flow is biased to the left. As shown in FIG. 12, when the movable plate 34 is on the right side, the water flow is biased to the right. As shown in FIG. 13, the insertion portion 31 is driven by the impeller 41 to rotate in the water outlet nozzle to constantly change the direction of the water flow, forming a shaking massage water.

Figure 4:
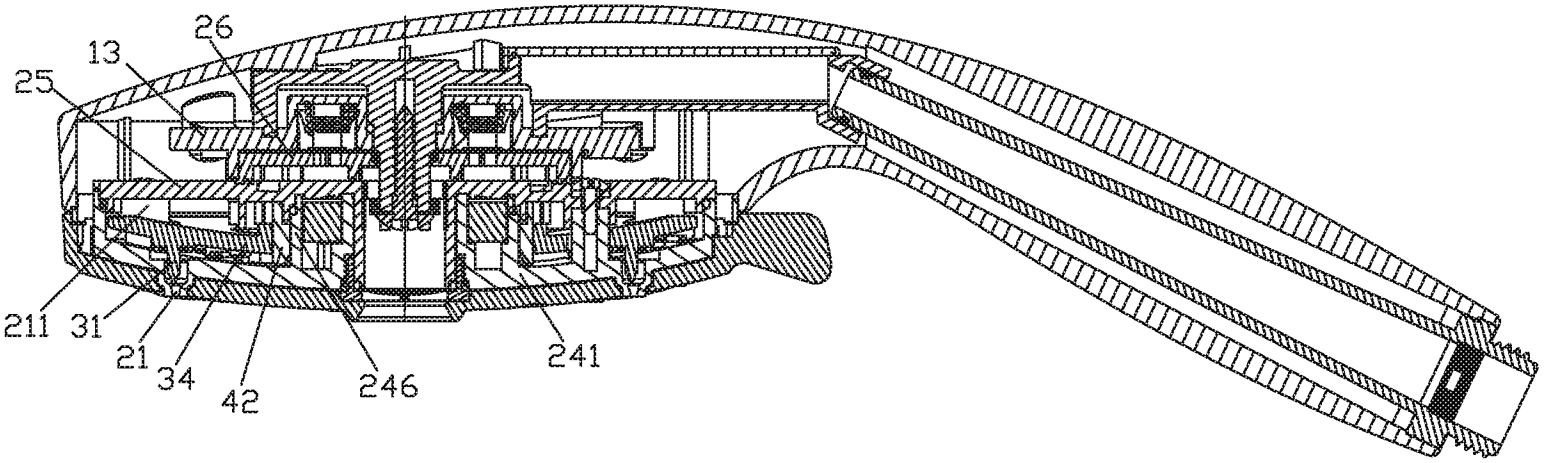
FIG. 4 illustrates a cross-sectional view taken along a direction of line A-A of FIG. 2, when the moving portion is in the first state.
Figure 5:
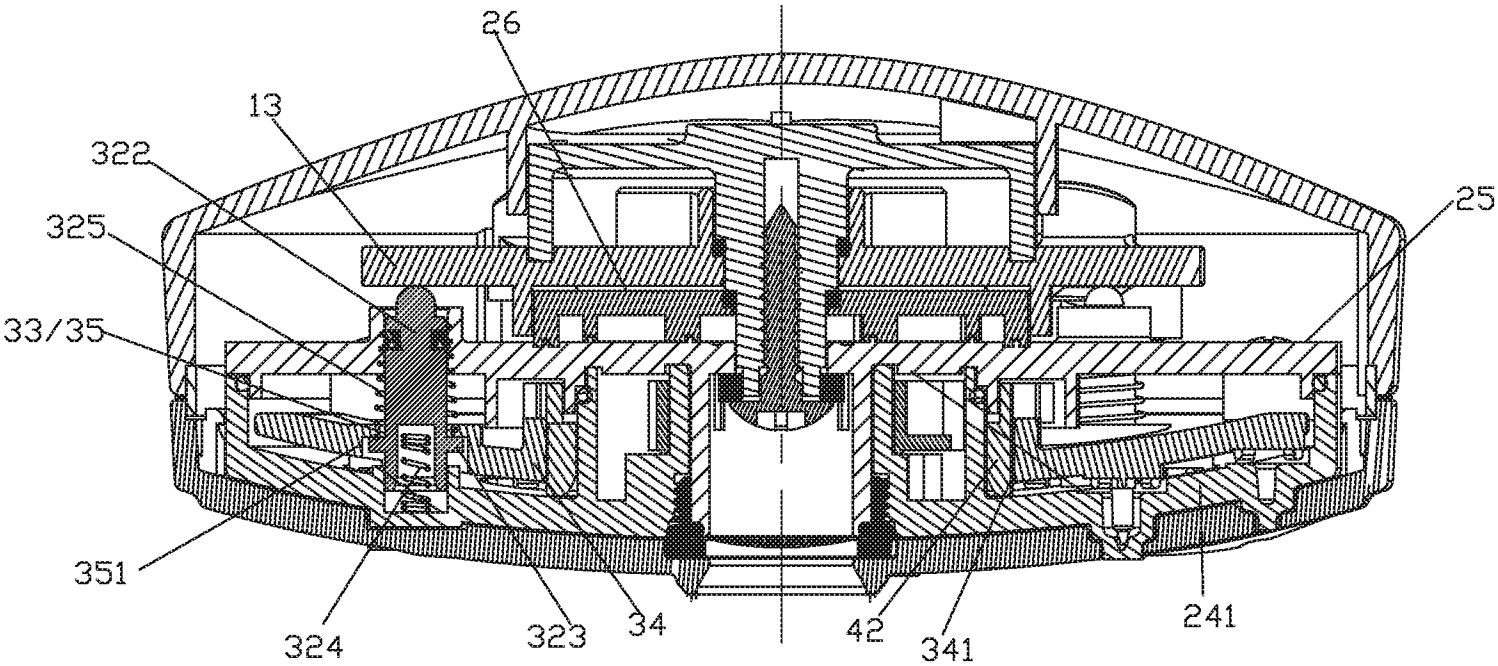
FIG. 5 illustrates a cross-sectional view taken along a direction of line B-B of FIG. 2, when the moving portion is in the first state.
Figure 6:
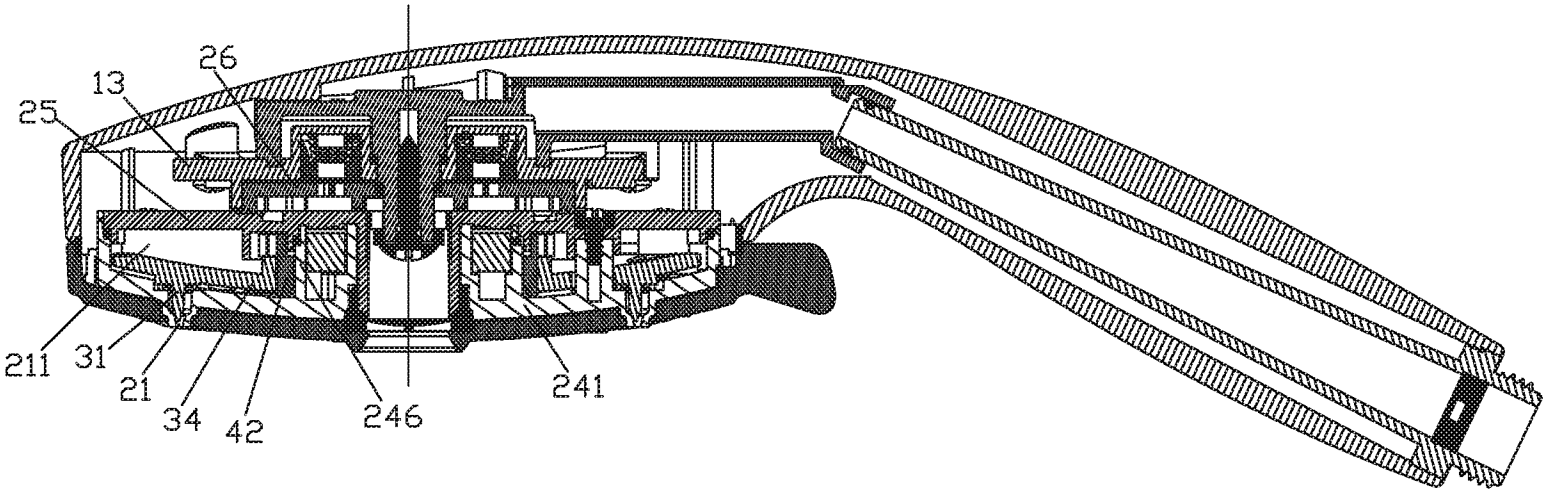
FIG. 6 illustrates a cross-sectional view taken along a direction of line A-A of FIG. 2, when the moving portion is in the second state.
Figure 7:
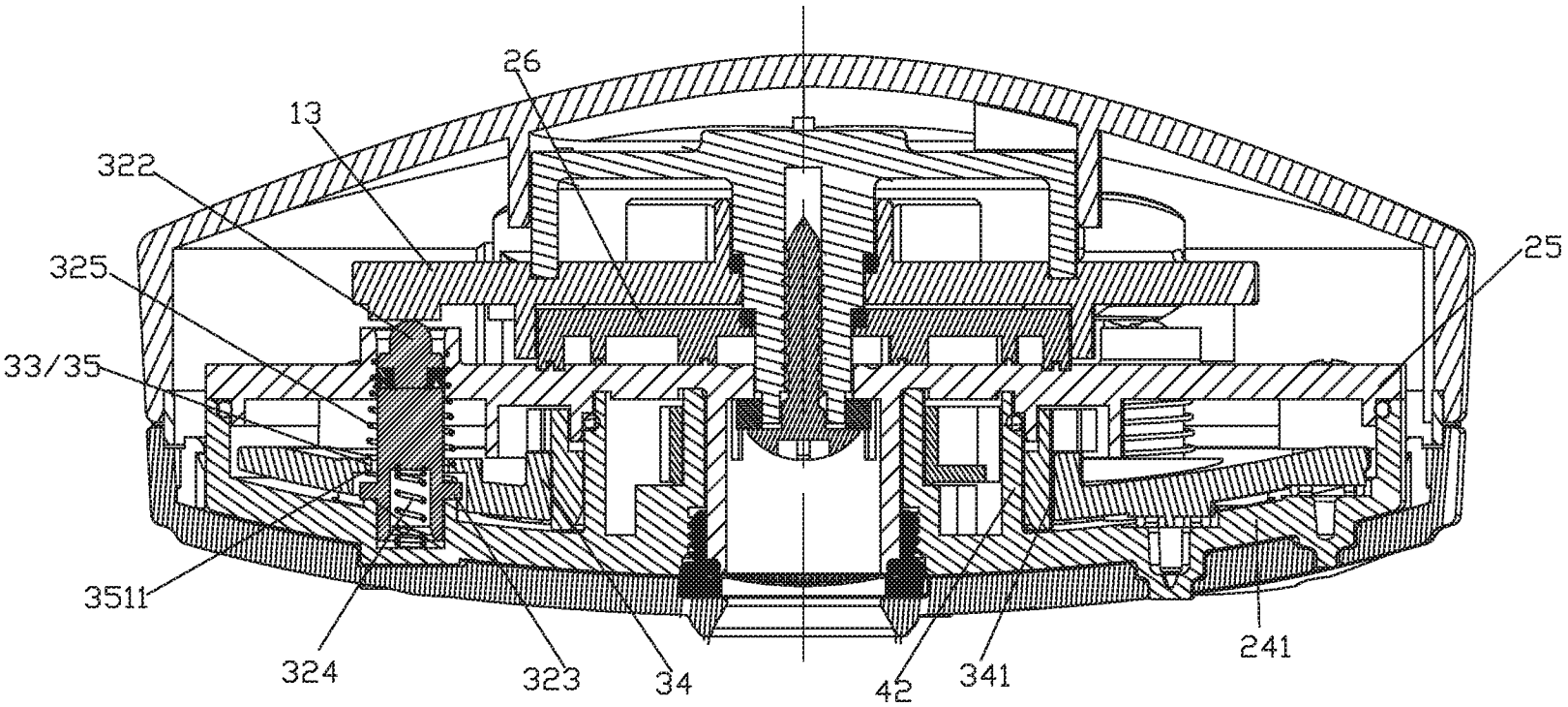
FIG. 7 illustrates a cross-sectional view taken along a direction of line B-B of FIG. 2, when the moving portion is in the second state.
Figure 8:
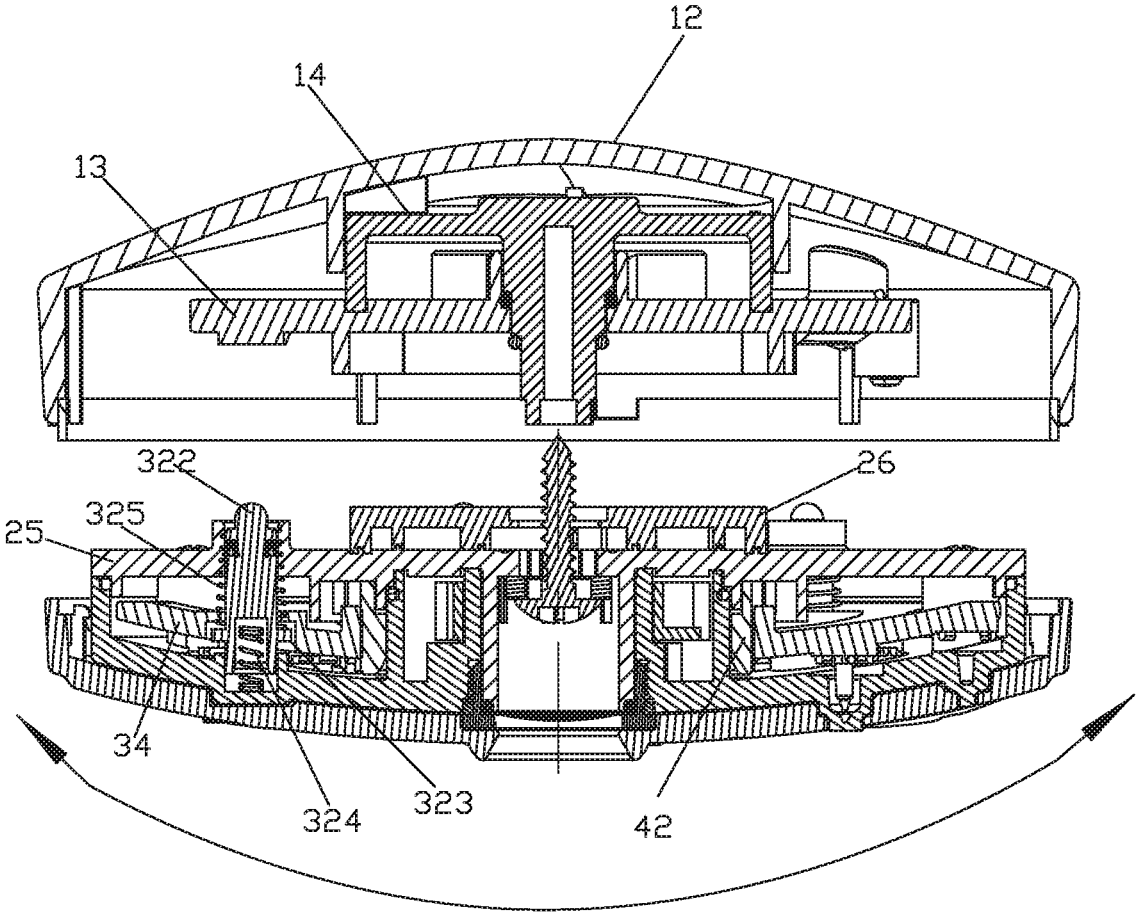
FIG. 8 illustrates an exploded perspective view of a portion of the water outlet device of the specific embodiment.
Figure 9:
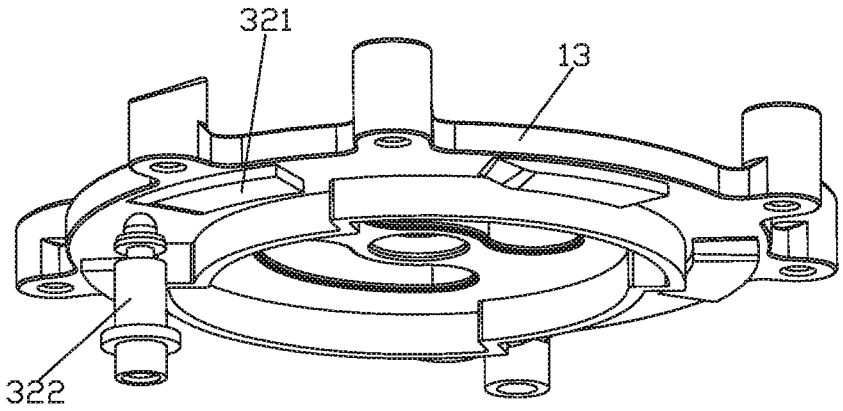
FIG. 9 illustrates a schematic view of a cooperation of the guiding surface and the positioning rod of the water outlet device of the embodiment, when the moving portion is in the first state.
Figure 10:
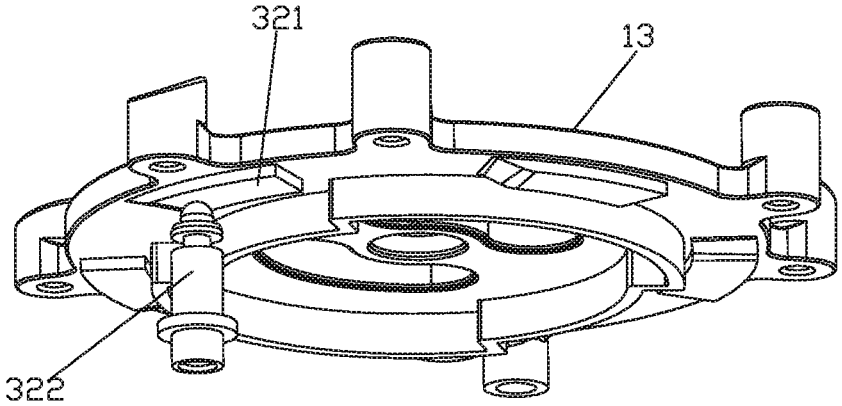
FIG. 10 illustrates a schematic view of a cooperation of the guiding surface and the positioning rod of the water outlet device of the embodiment, when the moving portion is in the second state.

In the specific embodiment, when the cover portion 20 is rotated to the shower water position (the first position), the moving portion 30 is in the first state, and the relative position of the positioning rod 322 and the body portion 10 is as shown in FIG. 9. The positioning rod 322 is lifted up under the action of the first elastic body 324 to drive the moving portion 30 to lift up, and the positioning rod and the moving portion are as shown in FIG. 4 and FIG. 5. The insertion portion 31 is pulled out from the first water outlet nozzle 21. Due to the insertion portion 31 being pulled out from the first water outlet nozzle 21, the circulating movement of the insertion portion 31 on the movable plate 34 does not disturb the water flow. At this time, the water inlet passage 11 is connected to the first water dividing passage 211, and the first water outlet nozzle 21 discharges shower water. When the cover portion 20 is rotated to the shaking water state (the second position), the moving portion 30 is in the second state, and the relative position of the positioning rod 322 and the body portion 10 is as shown in FIG. 10, the positioning rod 322 is pressed down by the guiding surface 321, and the moving portion 30 is pressed against the water outlet cover 24 by the second elastic body 325. The state of the positioning rod 322 and the moving portion 30 are as shown in FIG. 6 and FIG. 7. At this time the water inlet passage 11 is connected to the first water dividing passage 211, and the first water outlet nozzle 21 discharges shaking shower water. When the cover portion 20 is rotated to the massage water position (the third position), the water inlet passage 11 is connected to the second water dividing passage 221, and the second water outlet nozzle 22 discharges massage water. When the cover portion 20 is rotated to the sheet water (the fourth position), the water inlet passage 11 is connected to the third water dividing passage 231, and the third water outlet nozzle 23 discharges sheet water.

In a specific configuration of this embodiment, the cover portion 20 comprises a cover body 25 and a water dividing body 26. The water outlet cover 24 comprises a nozzle cover 241, a decorative cover 242 that fits the nozzle cover 241, and a small cover 243. The cover body 25 and the nozzle cover 241 are sealed and fixed together to form a portion of the water dividing passage described above, and the driving mechanism 40 is disposed in the first water dividing passage 211. Further, the cover body 25 is fixed with a downwardly facing first lower peripheral wall 251. The water outlet cover 24 is centrally provided with a through hole, and the periphery of the through hole extends upward to form a first upper peripheral wall 245. The top surface of the water outlet cover 24 is further provided with a second upper peripheral wall 246 surrounding the first upper peripheral wall 245. The outer peripheral edge of the nozzle cover 241 extends upwardly to form a third upper peripheral wall 247. The first lower peripheral wall 251 is configured to abut the inner wall of the first upper peripheral wall 245, and the small cover 243 is attached to the through hole of the nozzle cover 241. The third water outlet nozzle 23 is disposed on the small cover 243, and the space between the first lower peripheral wall 251 and the first upper peripheral wall 245 constitutes a portion of the third water dividing passage 231. A portion of the nozzle cover 241 between the first upper peripheral wall 245 and the second upper peripheral wall 246 is provided with a second water outlet nozzle 22, and the space between the first upper peripheral wall 245 and the second upper peripheral wall 246 constitutes a portion of the second water dividing passage 221. The portion of the nozzle cover 241 between the second upper peripheral wall 246 and the third upper peripheral wall 247 is provided with the first water outlet nozzle 21, and the space between the second upper peripheral wall 246 and the third upper peripheral wall 247 constitutes a portion of the first water dividing passage 211. The driving mechanism 40 is rotatably sleeved outside the second upper peripheral wall 246. The cover body 25 and the third upper peripheral wall 247 are sealed and fixed. The water dividing body 26 is fixed on the cover body 25, and the water dividing port is disposed on the top surface of the water dividing body 26. The positioning rod 322 is slidably coupled to the water dividing body 26 and the cover body 25, and the upper end of the positioning rod 322 protrudes above the cover body 25. The cover portion 20 is also provided with a button 27 for rotating the cover portion 20.

The body portion 10 comprises a main body 12, a fixing seat 13 and an inlet pipe 14. The main body 12, the fixing seat 13 and the inlet pipe 14 are fixedly connected together, and the fixing seat 13 is provided with the above-mentioned guiding surface 321. The water inlet 111 is provided at the fixing seat 13, and the fixing seat 13 cooperates with the water dividing body. The water inlet passage 11 comprises the inlet pipe 14 described above.

It will be apparent to those skilled in the art that various modifications and variation can be made in the present disclosure without departing from the spirit or scope of the invention. Thus, it is intended that the present disclosure cover the modifications and variations of this invention provided they come within the scope of the appended claims and their equivalents.

What is claimed is:

1. A water outlet device, comprising:

a water outlet portion, a moving portion disposed in the water outlet portion, and a driving mechanism, wherein:

the water outlet portion comprises a body portion and a cover portion connected to the body portion, the cover portion comprises at least one first water outlet nozzle, the moving portion is movable relative to the cover portion, the driving mechanism comprises an impeller, the impeller is rotatable in the water outlet portion, the impeller and the moving portion are drivably connected, movement between the cover portion and the moving portion at least comprises movement of the moving portion toward the cover portion and away from the cover portion, a transmission mechanism is disposed between the moving portion and the water outlet portion, the transmission mechanism drives the moving portion to move toward the cover portion and away from the cover portion, the moving portion comprises at least one insertion portion, the movement of the moving portion controls the at least one insertion portion to insert into or pull out from the at least one first water outlet nozzle, the at least one first water outlet nozzle discharges different water spray patterns when the at least one insertion portion is inserted into or pulled out from the at least one first water outlet nozzle, the movement of the moving portion further comprises a circulating movement, and the circulating movement comprises a circular movement or an oscillating movement of the at least one insertion portion around an axis of the at least one first water outlet nozzle.

2. The water outlet device according to claim 1, wherein:

the cover portion is rotatably connected to the body portion, the transmission mechanism cooperates with the moving portion and the body portion, and when the cover portion rotates relative to the body portion:

the transmission mechanism drives the moving portion to move toward to the cover portion and away from the cover portion.

3. The water outlet device according to claim 1, wherein:

the transmission mechanism comprises a guiding surface disposed on the water outlet portion and at least one positioning rod connected to the moving portion and moving in synchronization with the moving portion, an upper end of each of the at least one positioning rod is abuttable against the guiding surface, movement of the at least one positioning rod is controllable through a relative rotation of the guiding surface and the at least one positioning rod, and the movement of the moving portion is controllable.

4. The water outlet device according to claim 3, wherein the body portion is disposed with the guiding surface.

5. The water outlet device according to claim 3, wherein:

each of the at least one positioning rod comprises a shoulder, the moving portion comprises a movable plate, the at least one insertion portion is fixedly connected to the movable plate, the movable plate is disposed with at least one through hole, the upper end of each of the at least one positioning rod passes through a corresponding one of the at least one through hole, and the shoulder abuts a bottom surface of the movable plate.

6. The water outlet device according to claim 3, wherein:

the cover portion comprises a water outlet cover, the at least one first water outlet nozzle is disposed on the water outlet cover, the movement of the moving portion toward the cover portion and away from the cover portion moves the moving portion toward and away from the water outlet cover, and a first elastic body configured to reset the moving portion is:

disposed between a lower end of the at least one positioning rod and the water outlet cover, or disposed between the moving portion and the water outlet cover.

7. The water outlet device according to claim 3, wherein:

a second elastic body is disposed between the at least one positioning rod and the body portion, or the second elastic body is disposed between the moving portion and the body portion.

8. The water outlet device according to claim 1, wherein an elastic reset mechanism is disposed between the moving portion and the water outlet portion.

9. The water outlet device according to claim 3, wherein:

the water outlet portion comprises a water inlet passage and at least two water dividing passages, each of the at least two water dividing passages is switched to be connected to the water inlet passage by rotating the cover portion relative to the body portion, the cover portion further comprises other water outlet nozzles, a first one of the at least two water dividing passages is connected to the at least one first water outlet nozzle, and others of the at least two water dividing passages are connected to the other water outlet nozzles.

10. The water outlet device according to claim 9, wherein:

the at least two water dividing passages at least comprise a first water dividing passage and a second water dividing passage, each of the other water outlet nozzles at least comprises at least one second water outlet nozzle, the cover portion is rotatable between at least a first position, a second position, and a third position relative to the body portion, when the cover portion is rotated to the first position or the second position:

the first water dividing passage is connected to the water inlet passage, and the cover portion is rotated between the first position and the second position to control the movement of the moving portion, and when the cover portion is rotated to the third position:

the second water dividing passage is connected to the at least one second water outlet nozzle.

11. The water outlet device according to claim 9, wherein:

the water outlet portion comprises a switching mechanism, the water inlet passage comprises a water inlet port located in the body portion, each of the at least two water dividing passages comprises a water dividing port configured to follow a rotation of the cover portion, the switching mechanism comprises the water inlet port and the water dividing port, and the water dividing port is configured to be connected to the water inlet port by rotating the cover portion.

12. A water outlet device, comprising:

a water outlet portion, and a moving portion disposed in the water outlet portion, wherein:

the water outlet portion comprises a body portion and a cover portion connected to the body portion, the cover portion comprises at least one first water outlet nozzle, the moving portion is movable relative to the cover portion, movement between the cover portion and the moving portion at least comprises movement of the moving portion toward the cover portion and away from the cover portion, a transmission mechanism is disposed between the moving portion and the water outlet portion, the transmission mechanism drives the moving portion to move toward the cover portion and away from the cover portion, the moving portion comprises at least one insertion portion, the movement of the moving portion controls the at least one insertion portion to insert into or pull out from the at least one first water outlet nozzle, the at least one first water outlet nozzle discharges different water spray patterns when the at least one insertion portion is inserted into or pulled out from the at least one first water outlet nozzle, the transmission mechanism comprises a guiding surface disposed on the water outlet portion and at least one positioning rod connected to the moving portion and moving in synchronization with the moving portion, an upper end of each of the at least one positioning rod is abuttable against the guiding surface, movement of the at least one positioning rod is controllable through a relative rotation of the guiding surface and the at least one positioning rod, the movement of the moving portion is controllable, each of the at least one positioning rod comprises a shoulder, the moving portion comprises a movable plate, the at least one insertion portion is fixedly connected to the movable plate, the movable plate is disposed with at least one through hole, the upper end of each of the at least one positioning rod passes through a corresponding one of the at least one through hole, and the shoulder abuts a bottom surface of the movable plate.

* * * * *